US009232851B2

(12) United States Patent
Manici

(10) Patent No.: US 9,232,851 B2
(45) Date of Patent: Jan. 12, 2016

(54) VARIABLE PITCH MASCARA BRUSH

(75) Inventor: Davide Manici, Beverate di Brivio (IT)

(73) Assignee: Albea Services, Gennevilliers (FR)

( * ) Notice: Subject to any disclaimer, the term of this patent is extended or adjusted under 35 U.S.C. 154(b) by 0 days.

(21) Appl. No.: 12/993,720

(22) PCT Filed: May 15, 2009

(86) PCT No.: PCT/EP2009/003477

§ 371 (c)(1),
(2), (4) Date: Nov. 19, 2010

(87) PCT Pub. No.: WO2009/141098

PCT Pub. Date: Nov. 26, 2009

(65) Prior Publication Data

US 2011/0067725 A1 Mar. 24, 2011

Related U.S. Application Data

(60) Provisional application No. 61/054,615, filed on May 20, 2008.

(51) Int. Cl.

| | |
|---|---|
| ***A46B 3/02*** | (2006.01) |
| ***A45D 40/26*** | (2006.01) |
| ***A46B 9/02*** | (2006.01) |

(52) U.S. Cl.

CPC ..... *A46B 9/021* (2013.01); *A45D 40/265* (2013.01); *A46B 3/02* (2013.01); *A46B 2200/106* (2013.01); *A46B 2200/1053* (2013.01)

(58) Field of Classification Search

CPC ..... A46B 9/021; A46B 2200/1053; A46B 2200/106; A46B 3/02; A46B 3/005; A46B 1/00; A46B 2200/1046; A45D 40/265

USPC ..... 132/212, 216, 218, 320; 401/129; D4/128, 133; D28/76; 15/160, 187, 15/188, 207.2

IPC ..... A45D 40/26

See application file for complete search history.

(56) References Cited

U.S. PATENT DOCUMENTS 3,998,235 A * 12/1976 Kingsford ..... 132/218
4,404,977 A * 9/1983 Vasas ..... 132/218

(Continued)

FOREIGN PATENT DOCUMENTS

EP 1872682 A 1/2008
GB 2146520 A 4/1985

(Continued)

OTHER PUBLICATIONS

PL Hurricks, Feb. 2011, Springs Section 5.2 Tapered Helical Compression Springs pp. 7-8.*

(Continued)

*Primary Examiner* — Robyn Doan
*Assistant Examiner* — Tatiana Nobrega
(74) *Attorney, Agent, or Firm* — Banner & Witcoff, Ltd.

(57) ABSTRACT

A brush for applying mascara or the like, comprising an elongated core and a plurality of coating surfaces axially spaced along the elongated core, distributed around the core over a substantial portion of the length of the core extending from the distal end thereof. The coating surfaces are arranged in a plurality of rows forming turns of at least one helix extending lengthwise of the core and spaced laterally around the core periphery. The axial distance between consecutive rows of coating surfaces varies longitudinally along the core.

15 Claims, 3 Drawing Sheets

(56) References Cited

U.S. PATENT DOCUMENTS

| | | | | |
|---|---|---|---|---|
| 4,527,575 | A * | 7/1985 | Vasas | 132/218 |
| 4,886,387 | A * | 12/1989 | Goldberg et al. | 401/122 |
| 4,887,622 | A * | 12/1989 | Gueret | 132/320 |
| 5,335,465 | A * | 8/1994 | Gueret | 132/218 |
| 5,709,230 | A * | 1/1998 | Miraglia | 132/218 |
| 5,722,436 | A * | 3/1998 | Vandromme et al. | 132/218 |
| 6,279,583 | B1 * | 8/2001 | Neuner | 132/218 |
| 6,295,994 | B1 * | 10/2001 | Thayer et al. | 132/218 |
| 6,345,626 | B1 * | 2/2002 | Bouix | 132/218 |
| 7,089,946 | B2 * | 8/2006 | Rousselet | 132/218 |
| D539,547 | S * | 4/2007 | Leung | D4/128 |
| 7,762,269 | B2 * | 7/2010 | Wyatt et al. | 132/218 |
| D637,004 | S * | 5/2011 | Manici | D4/128 |
| 2002/0014251 | A1 * | 2/2002 | Gueret | 132/218 |
| 2002/0023658 | A1 * | 2/2002 | Gueret | 132/218 |
| 2002/0059942 | A1 * | 5/2002 | Neuner et al. | 132/218 |
| 2008/0011317 | A1 * | 1/2008 | Malvar et al. | 132/218 |
| 2008/0023020 | A1 * | 1/2008 | Gueret | 132/218 |
| 2008/0023024 | A1 * | 1/2008 | Manici et al. | 132/320 |
| 2008/0060669 | A1 * | 3/2008 | Malvar et al. | 132/218 |
| 2008/0083421 | A1 * | 4/2008 | Malvar et al. | 132/218 |
| 2008/0142034 | A1 * | 6/2008 | Manici et al. | 132/218 |
| 2008/0163885 | A1 * | 7/2008 | Schrepf | 132/218 |
| 2008/0196735 | A1 * | 8/2008 | Wyatt et al. | 132/218 |
| 2008/0245382 | A1 * | 10/2008 | Marciniak-Davoult et al. | 132/200 |
| 2009/0014022 | A1 * | 1/2009 | Salciarini | 132/200 |
| 2009/0071499 | A1 * | 3/2009 | Wyatt et al. | 132/218 |
| 2009/0214284 | A1 * | 8/2009 | Gueret | 401/121 |
| 2010/0294299 | A1 * | 11/2010 | Gueret | A45D 34/042 132/218 |
| 2011/0168204 | A1 * | 7/2011 | Gueret | 132/218 |
| 2012/0093566 | A1 * | 4/2012 | Gueret | A45D 34/046 401/122 |
| 2013/0104925 | A1 * | 5/2013 | Caulier | A45D 40/262 132/218 |
| 2013/0195539 | A1 * | 8/2013 | Fontaine | A45D 40/262 401/129 |

FOREIGN PATENT DOCUMENTS

| | | | |
|---|---|---|---|
| WO | 2007042061 | A | 4/2007 |
| WO | 2009037609 | A | 3/2009 |

OTHER PUBLICATIONS

Richard Budynas and J. Keith Nisbett, 2008, Shigley's Mechanical Engineering Design, Chapter 10, Section 10-14 Miscellaneous Springs pp. 540-542.*

International Search Report, Oct. 2009.

* cited by examiner

VARIABLE PITCH MASCARA BRUSH

FIELD OF THE INVENTION

The present invention relates to devices for applying compositions, in particular cosmetic compositions on hairs, and in particular on hairs such as the eyelashes or eyebrow hairs.

BACKGROUND OF THE INVENTION

Mascara brushes of the type commonly referred to as "twisted wire" brushes are well known and widely used in the cosmetics industry. A twisted wire mascara brush has an axially elongated twisted wire core with a multiplicity of fibers such as bristles clamped at their midpoints in the core and extending radially outwardly therefrom; the core is constituted of two lengths of wire, which may be initially separate or may be opposed legs of a single U-shaped wire, twisted together into a helix to hold the bristles between them. Typically, the bristles are more or less uniformly distributed for at least most of the length of the brush, and the overall shape of the brush (i.e., the notional envelope defined by the tips of the bristles) has a rectilinear axis and a simple circular cross-section, being cylindrical, frustoconical, or a tandem arrangement of proximal cylindrical and distal frustoconical portions.

Although the combination of a twisted wire core and a radiating array of bristles clamped in the core provides an acceptable brush structure for uses exemplified by the application of mascara, twisted-in-wire mascara brushes have certain disadvantages. One such disadvantage would be the finite number of ways fibres can be used to create an application surface for the mascara while at the same time serving a market continually looking for differentiation. Moreover, a conventional twisted-wire brush offers essentially only one kind of brush profile for use both to transfer the mascara from the container to the face and to apply the mascara to the eye lashes. To enable improved application, it would be beneficial to provide mascara brushes having structures other than uniformly distributed bristle arrays with simple cylindrical and/or conical envelopes of circular cross-section; but the diversity of possible configurations of twisted-in-wire brushes is restricted by the requirement to trim the bristles in order to achieve desired shapes, and the difficulty of forming and positioning cutters to effect such trimming.

It has also been proposed heretofore to employ plastic brushes and combs as mascara applicators.

There nevertheless remains a need for designs affording or permitting enhanced functional versatility (e.g., thickening, lengthening and separation as well as delivery of mascara to the lashes). In particular, there is a need for a mascara design that satisfies two requirements for achieving a pleasing make-up effect on the lashes: first, the retention and application of mascara to the lashes and second, the combing and separation of the lashes to which the mascara has been applied.

Various prior art injection-molded applicators have attempted to satisfy these requirements, using different bristle shapes, as well as a variety of bristle row distributions, densities, etc.

It is known from U.S. Pat. Nos. 4,964,429 and 6,616,366, for example, to arrange teeth in one or more rows extending helically around and along the stem. Such an arrangement, which replicates the distribution of bristles of a traditional twisted wire mascara brush, is known to provide advantageous effects in terms of hair combing and separation.

The amount of mascara retained between the fingers of these applicators has nevertheless found to be insufficient to provide the desired amount of product on the application surface.

Indeed, such brush configurations do not enable a sufficient quantity of cosmetic product to be collected whenever the brush is dipped into the container and especially following withdrawal from the container. The user is therefore forced to repeatedly insert the applicator into the container to load more product which may lead to contamination of the container's supply.

In other cases, if the cosmetic product is more viscous, the brush may be loaded with too great a quantity of mascara. Such an overloaded brush may lead to unwanted effects following application onto the lashes, such as clumping. Furthermore, the excess cosmetic product tends to accumulate onto the brush surface and dry out thereby reducing the separation ability of the brush bristles. Also, the unused cosmetic product trapped between the brush bristles will be reinserted into the container before a next application and therefore will become mixed with the container's supply, increasing the chances of pollution and contamination.

There exists therefore a need for a mascara brush which provides sufficient product retention capabilities.

It is also known to provide adjustable mascara brushes having coating surfaces in which the axial distance between each coating surface is adjustable. Such a mascara brush, described for example in U.S. Pat. No. 3,998,235, allows a user to vary the distance between the coating surfaces by acting upon a helical spring structure which compresses or expands. Unfortunately, with such an applicator, following adjustment, the axial distance of separation between the coating surfaces is constant, that is, the amount of product loaded between each pair of consecutive coating surfaces is the same. A single application effect will therefore be provided when the mascara brush is used.

Therefore, there exists a need for a mascara brush configuration that allows more than one metered quantity of mascara to be retained and applied.

SUMMARY OF THE INVENTION

Accordingly, there is provided a mascara brush which provides improved product retention capabilities through a configuration of coating surfaces arranged in a plurality of rows extending helically lengthwise of the mascara brush core.

Furthermore, there is provided a mascara brush configuration which provides a variable quantity of mascara to be retained in different brush areas and applied to different lash areas for providing a variety of makeup effects within a single application.

In a broad aspect of the present invention, there is provided a brush for applying mascara or the like, comprising an elongated core, a plurality of coating surfaces axially spaced along the elongated core having a distal end and a proximal end, the coating surfaces are distributed around the core over a substantial portion of the length of the core extending from the distal end thereof, the proximal end of the core is formed as a coating surface-free shank for attachment to an applicator handle, and the coating surfaces are arranged in a plurality of rows extending helically lengthwise of the core and spaced laterally around the core periphery, the axial distance between consecutive rows of coating surfaces varying longitudinally along the core.

Further features and advantages of the invention will be apparent from the detailed description hereinbelow set forth, together with the accompanying drawings.

DRAWINGS

DESCRIPTION OF THE INVENTION

Figure 1:
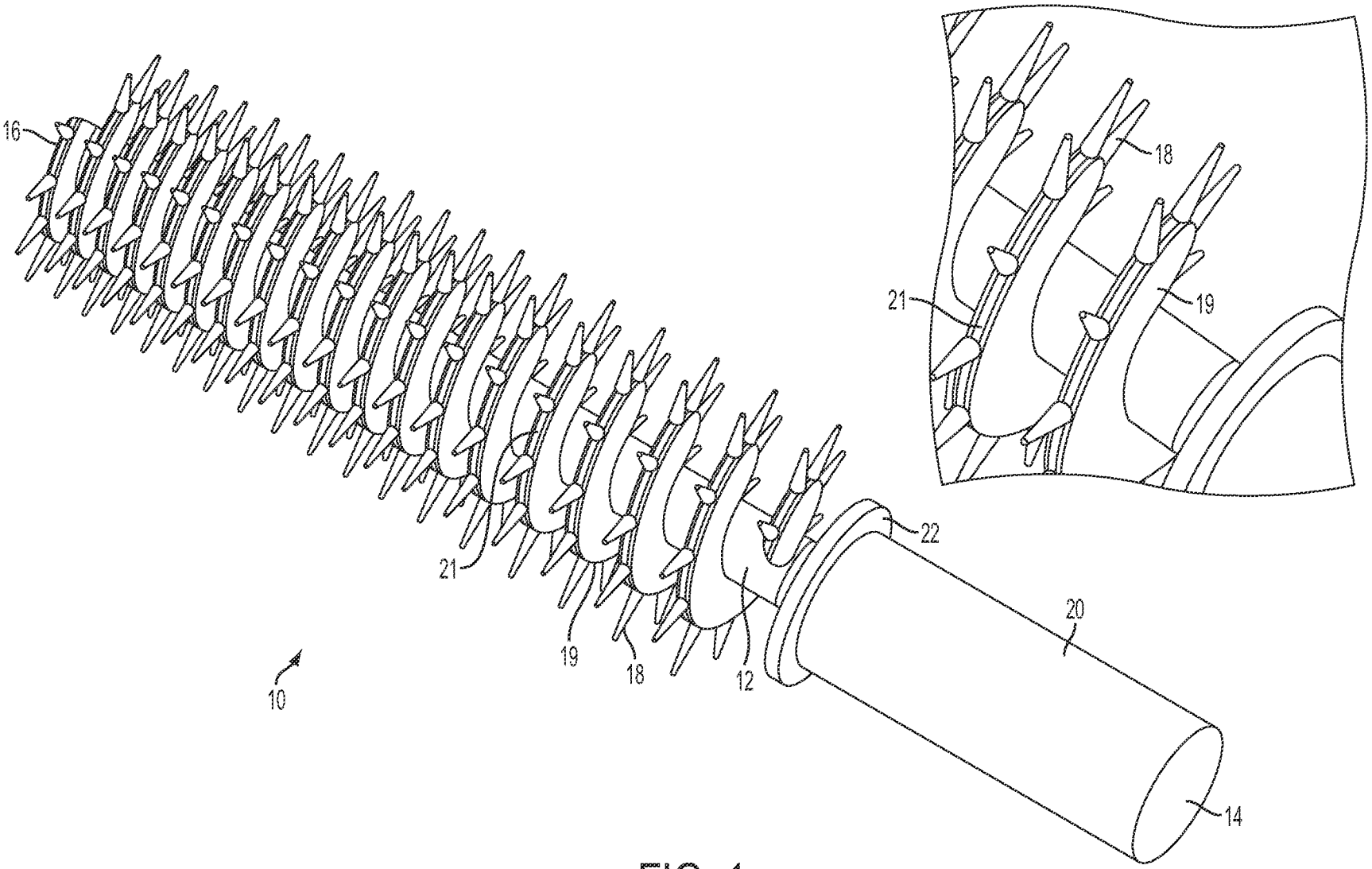
FIG. 1 is a plan view of a mascara brush embodying the present invention in a particular form.
Figure 2:
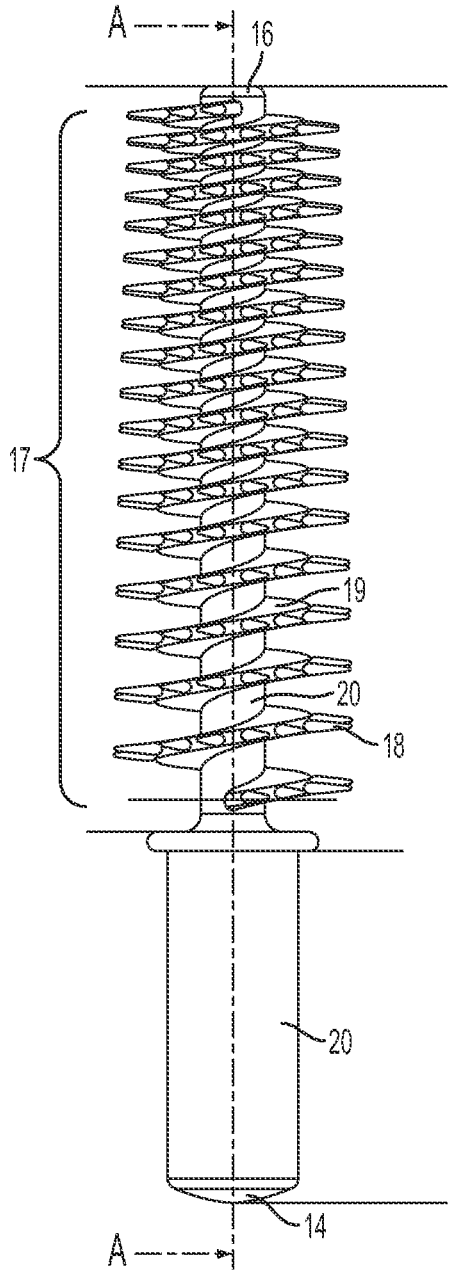
FIG. 2 is a side view of the brush of FIG. 1.

FIGS. 1-4 illustrate a mascara brush 10 embodying the present invention. This brush includes a molded plastic body 11 comprising an elongated cylindrical core 12 with an initially rectilinear long geometric axis, a proximal end 14 and a distal end 16, and a multiplicity of bristles or fibers 18 projecting laterally outwardly from the core (transversely of the core axis) over a major portion of the length of the core from its distal end toward its proximal end. The proximal end portion of the core is formed as a shank 20, being bristle-free and (in this particular embodiment) slightly larger in diameter than the remainder of the core. A small flange 22 is provided between the shank and the bristle-bearing portion of the core in this embodiment.

In common with conventional mascara brushes, the brush 10 is designed to be mounted at its proximal end in a stem (not shown) of an applicator handle (also not shown) which includes a cap (not shown) for closing the neck of a container of mascara, such that when the cap is seated on the container neck, the brush is positioned within the container in contact with mascara. When opening the container, the user grasps the cap and withdraws the brush, transporting a quantity of mascara on and between the brush bristles for application to the eyelashes. Manipulating the cap, the user brings the mascara-laden brush into contact with lashes for deposit and distribution of the mascara on the lashes.

As seen in FIG. 1, the coating surfaces 19 are arranged in a plurality of rows extending helically lengthwise of the core 12 and spaced laterally around the core 12 periphery. The coating surfaces 19 are therefore said to be describing a helix 17, each coating surface 19 being a helical turn.

In the embodiment shown in FIG. 1, the core 12 has a substantially circular periphery as seen in cross-section, of radius r. The coating surfaces 19 have a ring-like shape, with an inner radius equal to the radius r of the core 12, and an outer radius R. The peripheral rim 21 of the coating surfaces 19 also defines a substantially circular path. The coating surfaces can be said to have a radial depth (R-r) equal to a difference between the outer radius R and the inner radius r.

In one embodiment of the present invention the helix 17 has an essentially constant outer radius R, such that all coating surfaces 19 have the same surface area. In other embodiments the helix 17 could be a spiral, with helical turns having monotonically increasing or decreasing radii. In such embodiments the surface area of each coating surface 19 would be variable.

In yet a different embodiment of the present invention, more than one helix 17 of coating surface 19 can be present around the core. In such an embodiment, two helices of coating surfaces could be arranged around the core 12 in a non-overlapping way, for example by choosing the pitch of a first helix to be a multiple of the pitch of the second helix.

The helix shown in FIG. 1 has coating surfaces 19 having a peripheral rim 21 defining a substantially circular path, i.e. the coating surfaces 19 have a disk or ring-like shape. In such an embodiment, the outer radius R is constant for a given coating surface 19. Beside the circular cross-sectional helix shown, various alternative cross-sectional shapes of the helix are however possible, such as elliptical, rectangular, triangular, polygonal, etc. In such other embodiments, the outer radius R varies for a given coating surface 19.

Furthermore, the individual cross-sectional shapes may be used, not only for an entire helix, but the helix' cross-section may vary in shape along its length to provide further control over the bristle arrangement and distribution.

Figure 3:
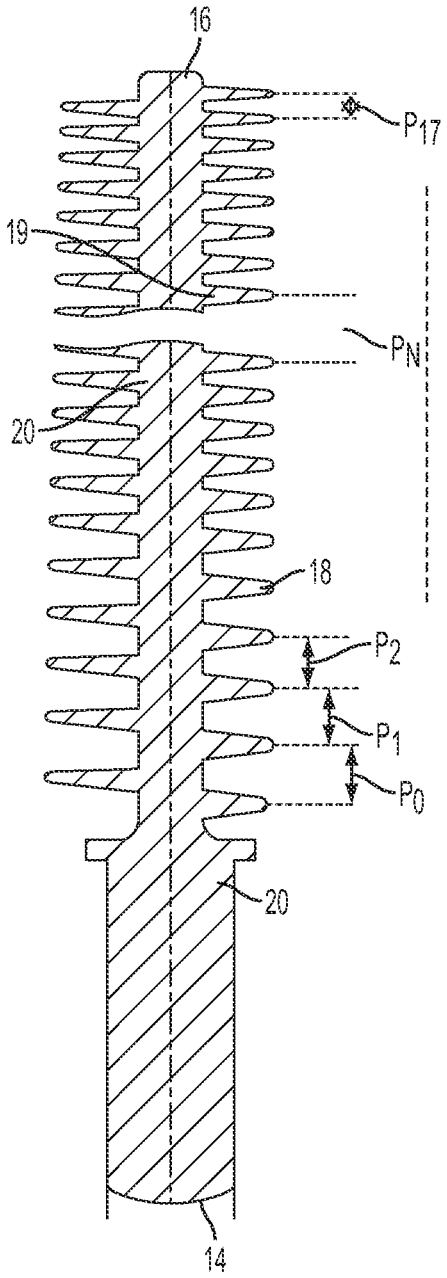
FIG. 3 is a sectional view of the brush of FIG. 1.

For a helix 17 such as the one shown in FIG. 1, the axial distance $P_N$ between consecutive rows of coating surfaces 19, the pitch of the helix, varies longitudinally along the core. As shown in FIG. 3, the axial distance $P_0$ between a first and a second coating surface 19 is larger than the distance $P_1$ between a second and a third coating surface 19, while the distance $P_2<P_1<P_0$, and so on. At the distal end 16 of the brush 10, the axial distance separating consecutive rows of coating surfaces 19 is the smallest.

In the embodiment shown in FIG. 3, the axial distance $P_N$ between consecutive rows decreases along the direction from the proximal end 14 of the core towards the distal end of the core 16. The axial distance $P_N$ between consecutive rows could also increase along the direction from the proximal end 14 of the core towards the distal end of the core 16. Alternatively, the axial distance $P_N$ between consecutive rows could decrease over a portion of the core 12 in the longitudinal direction and increase over another portion of the core 12.

A variety of configurations of the axial distance between rows of coating surfaces 19 varying longitudinally along the core 12 are within the scope of the present invention.

The separations between adjacent rows of coating surfaces 19 effectively form reservoir gaps which retain mascara for application. The reservoir gaps become filled with mascara when the brush is immersed in a container of mascara supply. The reservoir gaps, defined by the axial distance between consecutive rows of coating surfaces 19, have variable volume at different areas of the brush, becoming loaded with more or less product.

In the embodiment shown in FIG. 1, the axial distance between consecutive rows of coating surfaces 19 decreases along the direction from the proximal end 14 of the core towards the distal end 16 of the core. In such a configuration, the coating surfaces 19 at the distal end 16 of the core 12 are more densely distributed providing a brush area retaining less product. Such a brush application area will provide a separating effect and improved lash definition. Conversely, the coating surfaces 19 at the proximal end 14 of the core 12 are more loosely distributed providing a brush area retaining more product. Such a brush area will provide a thickening effect to lashes.

Using the brush of the present invention, a user can advantageously insert the brush into the container and load, in a single gesture, an amount of product providing a separating effect and thickening effect to different lash areas.

In one embodiment of the present invention, the coating surfaces 19 are advantageously provided with bristles 18 distributed on a peripheral rim 21 thereof. In one particular configuration the bristles 18 are arrayed in a plurality of longitudinal rows extending lengthwise of the core 12. The bristles 14 can either be uniformly distributed around the entire rim 21 surface of each coating surface 19 or be provided on only a part thereof. Alternatively or additionally, the bristles 14 could be provided on only certain coating surfaces 19, such that certain coating surfaces 19, in one or more brush areas, are bristle-free.

The density of the bristles, their shape and material can also vary as it will be apparent to one skilled in the art, without departing from the nature and scope of the present invention.

In one particular embodiment, the bristles 18 have a conical shape and a free end with a radius of 0.05 mm. The bristle length l is 1.5 mm. The core 12 has a bristle-bearing distal portion 19.10 mm in axial length and 1.60 mm in diameter and a proximal shank portion 9.02 mm in axial length and 3.2 mm in diameter, separated by an integral flange 4.3 mm wide.

Figure 5:
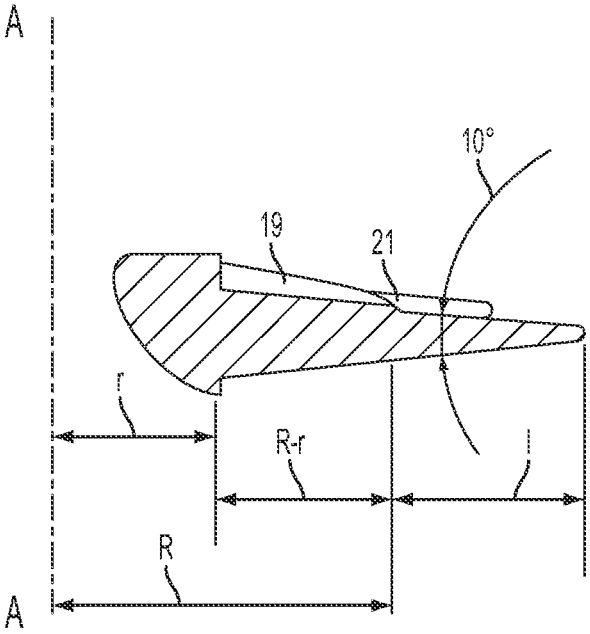
FIG. 5 is an enlarged fragmentary view of a bristle portion of the brush of FIG. 1.

Stated more broadly, in embodiments of this general type, and as shown in FIG. 5, the core radius (r) may be in a range of 0.8 mm to 2.5 mm, the helix radius (R) may be in a range of 2 mm to 3 mm and the bristle length (l) may be in a range of 1 mm to 4 mm, preferably between 1 and 2 mm. The radial depth (R-r) may be in a range of 0.5 to 2.2 mm. The bristle conicity θ is, in one embodiment, of 10°, but will vary depending on the bristle length l. The core 12 may be 17-18±10 mm in axial length.

Each coating surface 19 can have a thickness at least as large as the thickness of the bristle base (if the peripheral rim 21 includes bristles) or otherwise, any suitable thickness. The number of coating surfaces 19 is generally comprised between 15 and 30, but will vary depending on the length of the brush 10 and the thickness of the coating surfaces 19.

Figure 4:
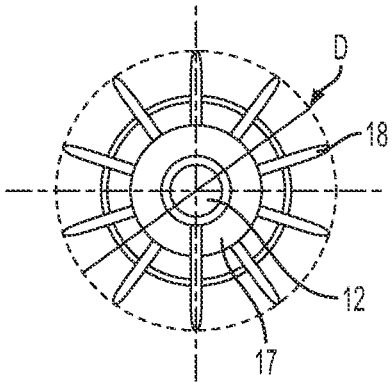
FIG. 4 is a view of the distal end of the brush of FIG. 1.

As shown in FIG. 4, the outer envelope defined by the brush 10 is generally smaller than 8 mm in diameter. The outer envelope diameter of the brush 10 is generally chosen smaller than the diameter of the wiper. The difference between the wiper diameter and the stem diameter can be about 1 mm.

The core 12 and bristles 18 together are molded integrally of a suitable plastic material such as (for example) a "HYTREL®" thermoplastic polyester elastomer commercially available from DuPont, a "PELLETHANE™" thermoplastic polyurethane elastomer commercially available from Dow, or "T-BLEND™" compounded thermoplastic material composed primarily of SBS or SEBS. Other suitable materials may include polyamide, liquid silicone rubber, etc.

That is to say, by way of nonlimiting illustration, the brush may be made of a compounded thermoplastic material composed primarily of "PELLETHANE™" polyurethane elastomer (100% straight or blended), or composed primarily of "HYTREL®" polyester elastomer (100% straight or blended), or composed primarily of low density polyethylene (LDPE) and/or "CHEVRON EXACT™" elastomer, The molding operation is a standard. injection molding process, which is familiar to persons skilled in the art. It employs a mold cavity having the configuration of the brush body to be made; for economy of production, a single mold. may have a plurality (e.g., eight) of such cavities.

Alternatively, the brush 10 of the present invention could be manufactured through bi-injection molding, whereby different materials may be used for the core 12 and the helix 17.

Figure 6:
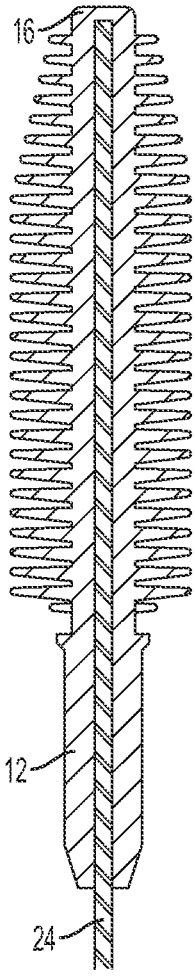
FIG. 6 is a sectional view of an embodiment of a brush having a wire extending longitudinally through the brush.

In an alternative embodiment of the invention, shown in FIG. 6, a shape-retaining wire 24 extends longitudinally through the center of the brush core 12, from end to end thereof, essentially coaxially with the core. Thus, the distal end of the wire is disposed at the distal end 16 of the core 12, the proximal end of the wire extends through and beyond the proximal end 14 of the core 12, so as to be received within a stem of an applicator handle (not shown).

The wire 24, in this embodiment of the invention, is a manually bendable but substantially non-resilient metal wire that is self-sustaining in shape, i.e., capable of retaining its shape whether axially rectilinear or in any curved shape into which it may be bent. Examples of wires suitable for use as the wire 24 are stainless steel wires of 0.0240, 0.0286, 0.0320 and 0.0350 inch gauge.

The core 12 and bristles 18 are molded integrally of a suitable plastic material such as (for example) a "HYTREL" thermoplastic polyester elastomer commercially available from DuPont, a "PELLETHANE" thermoplastic polyurethane elastomer commercially available from Dow, of "T-BLEND™" compounded thermoplastic material composed primarily of SBS or SEBS. The molding operation is a standard injection molding process, which is familiar to persons skilled in the art. It employs a mold cavity having the configuration of the brush body to be made; for economy of production, a single mold may have a plurality (e.g., eight) of such cavities. A wire 24 is inserted into each mold cavity before the plastic material is introduced, so that the brush body is molded over the wire.

A particular advantage of molded plastic mascara brushes, as opposed to twisted-in-wire brushes, is their freedom from constraint as to envelope shape and arrangement of bristles, owing to the versatility of the molding process. Thus, bristle dimensions and arrangement (e.g. with bristles aligned in rows spaced apart by unequal distances and/or with different bristle spacing in different rows) can be designed and provided for performance of one or more functions incident to mascara application, such as lash building or thickening, lengthening and separation.

The notional envelope defined by the bristle tips may include a first cylindrical portion, extending from the flange toward the distal end of the brush, and a second, frustoconical portion extending from the first cylindrical portion to the distal end and tapering to a minimum diameter at the brush distal end. As will be appreciated, within the first envelope portion the bristles all have the same length, but in the second portion they become progressively shorter in the direction toward the distal end.

A variety of bristle arrangements and configurations (e.g., including elimination of the conical shape of the bristle) may be used for performance of various functions such as lengthening, building and separation of the lashes.

While the above description has been made with respect to an applicator adapted for the application of mascara to lashes, similar applicators could be used for the application of a variety of liquid, semi-liquid, creamy, paste-like or viscous cosmetics materials to keratinous or other surfaces, without departing from the nature and scope of the present invention.

The invention claimed is:

1. A brush for applying mascara, comprising an elongated core having a periphery and a plurality of coating surfaces axially spaced along the elongated core, the core has a distal end and a proximal end, the coating surfaces are distributed around the core over a substantial portion of the length of the core extending from the distal end thereof, the proximal end of the core is formed as a coating surface-free shank for attachment to an applicator handle, and the coating surfaces are arranged in a plurality of rows forming turns of at least one helix extending lengthwise of the core and spaced laterally around the core periphery, the plurality of rows of coating surfaces are contained between a first coating surface adjacent the coating surface-free shank and a last, distal-most coating surface at the distal end of the core;

wherein the axial distance between adjacent coating surfaces is largest between the first and a coating surface adjacent the first coating surface; the axial distance between adjacent coating surfaces is smallest between the coating surface adjacent the last, distal-most coating surface and the last, distal most coating surface; and the axial distance between consecutive rows of coating surfaces continuously decreases along the core from the proximal end to the distal end such that each axial distance is smaller than the axial distance immediately proximal thereto and larger than the axial distance immediately distal thereto;

wherein the coating surfaces have bristles distributed on a peripheral rim thereof, each of the bristles having a length (l) and being arrayed in a plurality of longitudinal rows extending lengthwise of the core, the bristles and the coating surfaces are integrally molded.

2. A brush as claimed in claim 1, wherein the core has a substantially circular periphery as seen in cross-section and the coating surfaces have a peripheral rim defining a substantially circular path, the coating surfaces have a ring-like shape having an inner radius r, defined by a radius of the core, and an outer radius (R), the coating surfaces have a radial depth (R-r) equal to a difference between the outer radius (R) and the inner radius (r).

3. A brush as claimed in claim 2, wherein the length (1) is in the range 1-4mm.

4. A brush as claimed in claim 1, wherein the bristles are distributed only on a portion of the peripheral rim.

5. A brush as claimed in claim 1, wherein the bristles are spaced laterally along the peripheral rim of the coating surfaces at unequal angular distances from each other.

6. A brush as claimed in claim 1, wherein a notional envelope defined by the coating surfaces tapers toward the distal end.

7. A brush as claimed in claim 1, wherein, the lengths of the bristles in the longitudinal rows vary progressively along the length of the core such that tips of the bristles cooperatively define a notional envelope that decreases in a direction from the proximal end to the distal end.

8. A brush as claimed in claim 1, wherein the bristles are distributed such that there are at least two zones, disposed in tandem lengthwise of the core, differing from each other in bristle density.

9. A brush as defined in claim 1, made of a thermoplastic polyurethane elastomer.

10. A brush as defined in claim 1, made of a compounded thermoplastic material composed primarily of SBS or SEBS.

11. A brush as defined in claim 1, wherein the coating surfaces are arranged as two helices around the core in a non-overlapping way.

12. A brush as defined in claim 1, wherein the core is an elongated flexible plastic core and a bendable, substantially non-resilient wire is disposed within and extending lengthwise of the core for retaining a bend or curve imparted to the core.

13. A brush as defined in claim 1, wherein the core and coating surfaces are bi-injection molded.

14. A brush as defined in claim 2, wherein said inner radius (r) is in the range 0.8-2.5 mm, said outer radius (R) is in the range 2-3 mm and said radial depth (R-r) is in the range 0.5-2.2 mm.

15. A brush for applying mascara, comprising an elongated core having a periphery and a plurality of coating surfaces axially spaced along the elongated core, the core has a distal end and a proximal end, the coating surfaces are distributed around the core over a substantial portion of the length of the core extending from the distal end thereof, the proximal end of the core is formed as a coating surface-free shank for attachment to an applicator handle, and the coating surfaces are arranged in a plurality of rows forming turns of at least one helix extending lengthwise of the core and spaced laterally around the core periphery, the plurality of rows of coating surfaces are contained between a first coating surface adjacent the coating surface-free shank and a last, distal-most coating surface at the distal end of the core;

wherein the axial distance between adjacent coating surfaces is smallest between the first and a coating surface adjacent the first coating surface; the axial distance between adjacent coating surfaces is largest between the coating surface adjacent the last, distal-most coating surface and the last, distal most coating surface; and the axial distance between consecutive rows of coating surfaces continuously increases along the core from the proximal end to the distal end such that each axial distance is larger than the axial distance immediately proximal thereto and smaller than the axial distance immediately distal thereto;

wherein the coating surfaces have bristles distributed on a peripheral rim thereof, each of the bristles having a length (l) and being arrayed in a plurality of longitudinal rows extending lengthwise of the core, the bristles and the coating surfaces are integrally molded.

* * * * *